United States Patent [19]

Bozek

[11] Patent Number: 4,649,892

[45] Date of Patent: Mar. 17, 1987

[54] CROSS BOW WITH COCKING MECHANISM

[76] Inventor: John W. Bozek, 6093 Waterfront Dr., Waterford, Mich. 48095

[21] Appl. No.: 778,316

[22] Filed: Sep. 20, 1985

[51] Int. Cl.[4] ..... F41B 5/00

[52] U.S. Cl. ..... 124/25; 124/DIG. 1; 124/41 R

[58] Field of Search ..... 124/24 R, 25, 28, 31, 124/35 R, 86, 21, 22, 25 R

[56] References Cited

U.S. PATENT DOCUMENTS

| | | | |
|---|---|---|---|
| 1,866,926 | 7/1932 | Colby | 124/22 |
| 3,028,851 | 4/1962 | Drake | 124/25 |
| 3,043,287 | 7/1962 | Nelson | 124/25 |
| 3,783,852 | 1/1974 | Shepherd | 124/25 |

FOREIGN PATENT DOCUMENTS

| | | | |
|---|---|---|---|
| 56828 | of 1891 | Fed. Rep. of Germany | 124/25 |

*Primary Examiner*—Richard C. Pinkham
*Assistant Examiner*—Gary Jackson
*Attorney, Agent, or Firm*—John R. Benefiel

[57] ABSTRACT

A cross bow is disclosed which includes a cocking mechanism for moving the drawstring to the drawn position. A cocking lever is pivotally mounted beneath the cross bow stock member and an operating cable connected at one end to the cocking lever is pulled by pivoting motion of the cocking lever away from the stock member. The operating cable is connected at its other end to an engagement block movable in a lengthwise track and engages the drawstring either directly or through a slider element also mounted in the track, such as to be slid rearwardly upon pivoting of the cocking lever. A retraction spring acts on the engagement block for returning the same to the forward position as the cocking lever is pivoted to its return position.

7 Claims, 10 Drawing Figures

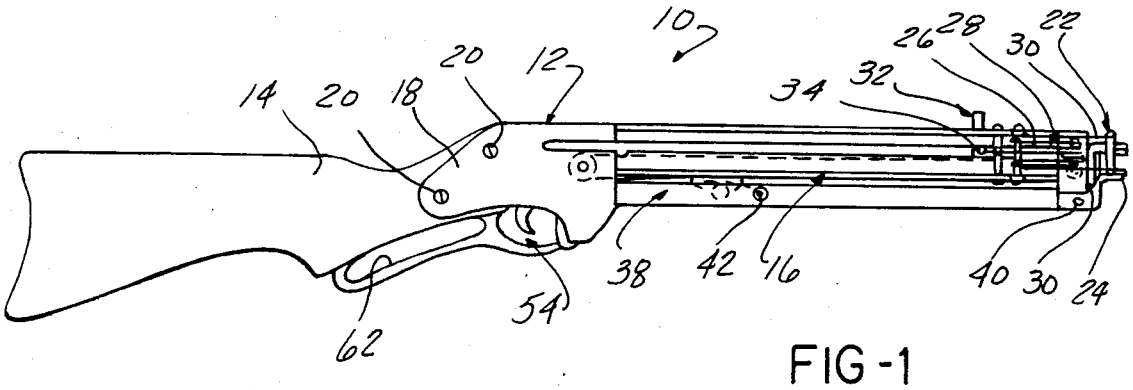
FIG-1
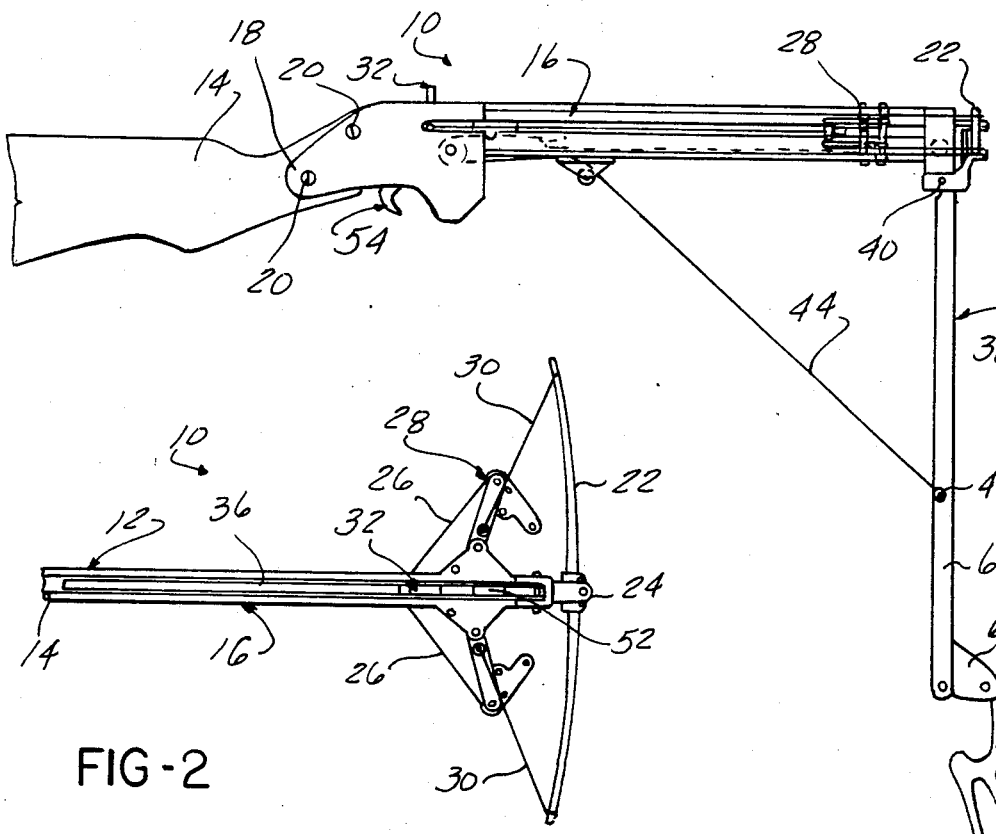
FIG-2
FIG-3

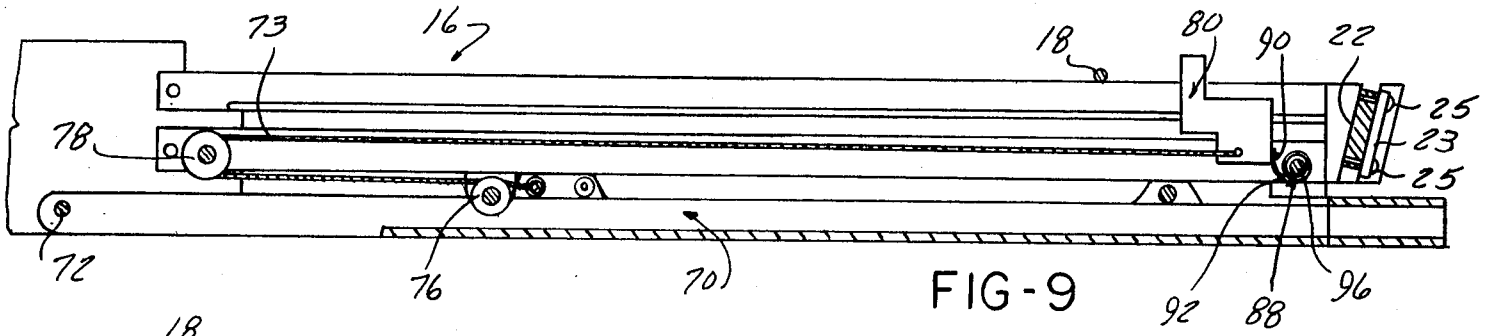
FIG-9
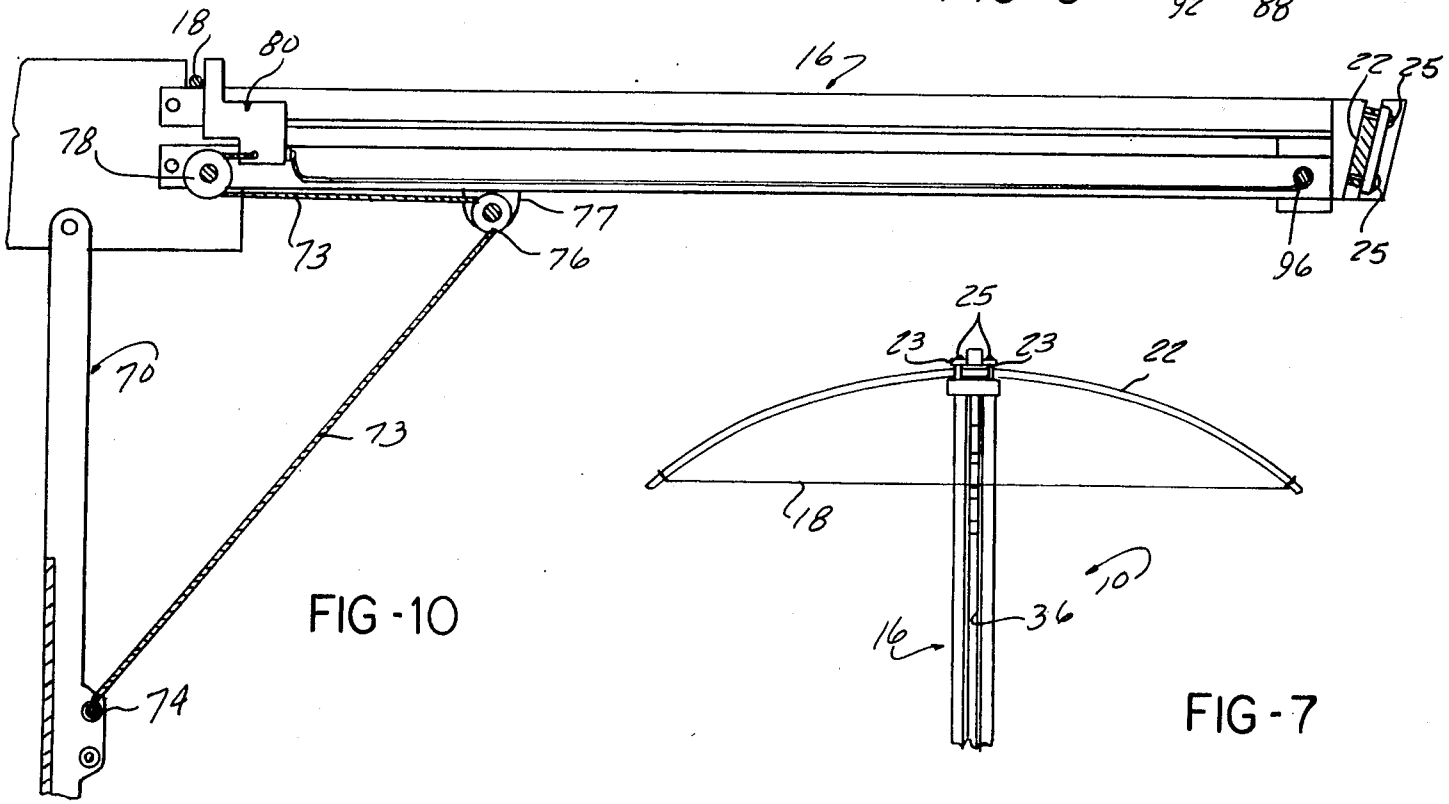
FIG-10
FIG-7

CROSS BOW WITH COCKING MECHANISM

BACKGROUND OF THE INVENTION

The present invention concerns cross bows, and more particularly, cross bows having cocking mechanisms for drawing the drawstring to the tensioned, drawn position.

DESCRIPTION OF THE PRIOR ART

It has heretofore been recognized that it would be advantageous to facilitate the cocking of a cross bow by providing a mechanism for this purpose rather than to rely on manual drawing of the drawstring.

Devices which have been heretofore been provided, however, have been complex, bulky, and cumbersome, such that cocking mechanisms are not commonly employed on cross bows. Examples of such devices are shown in U.S. Pat. No. 3,670,711, U.S. Pat. No. 3,043,287, U.S. Pat. No. 4,258,689. Ease of operation has not been achieved by many of these designs.

It is the object of the present invention to provide such a cross bow having a cocking mechanism which is relatively simple and compact, and yet may be easily manipulated with greatly reduced effort by a user.

SUMMARY OF THE INVENTION

This and other objects of the present invention which will become apparent upon a reading of the following specifications and claims are achieved by a cross bow cocking mechanism consisting of an elongated cocking lever, pivotally mounted to the cross bow stock member, such as to be moved from a position extending along and beneath the stock member to a pivoted position, down and away therefrom.

An operating cable is provided, which is connected at one end to an intermediate point on the cocking lever, and is pulled by pivoting motion of the cocking lever. The operating cable passes about a series of guide pulleys, such as to extend lengthwise along the stock member and is attached to an engagement block slidably movable in a lengthwise track formed along the length of the stock member frame. The engagement block is movable into engagement with of the drawstring, such that upon pulling of the engagement block the drawstring is moved rearwardly when the cocking lever is pivoted away from the stock member.

Retraction means is also provided, consisting of a wind-up spring having an extensible flexible strip attached to the opposite side of the engagement block, such as to be extended upon cocking motion, and thereafter retracting upon movement of the cocking lever to its initial position.

In two alternate disclosed embodiments, the cocking lever is pivoted either at its forward or its rear end. In the front pivoted version, a finger loop is formed integral with a trigger guard such as to enable ready gripping of the free end of the cocking lever, in order to accomplish the cocking motion.

In the alternate embodiment, a two piece cocking lever is employed, the separate pieces being extensible to extend the effective length of the cocking lever.

DESCRIPTION OF THE DRAWINGS

FIG. 1 is a side elevational view of a cross bow incorporating a cocking mechanism according to the present invention.

FIG. 2 is a fragmentary plan view of the front portion of the cross bow shown in FIG. 1.

FIG. 3 is a side elevational view of the cross bow shown in FIG. 1, with the cocking mechanism fully extended.

FIG. 7 is a fragmentary plan view of the front portion of the cross bow shown in FIG. 6.

FIG. 9 is a fragmentary enlarged sectional view of the cross bow shown in FIG. 6, depicting the details of the cocking mechanism in the return position.

FIG. 10 is an enlarged fragmentary sectional view of the cross bow shown in FIG. 8, showing the details of the cocking mechanism, with the cocking mechanism in the extended position.

DETAILED DESCRIPTION

Figure 4:
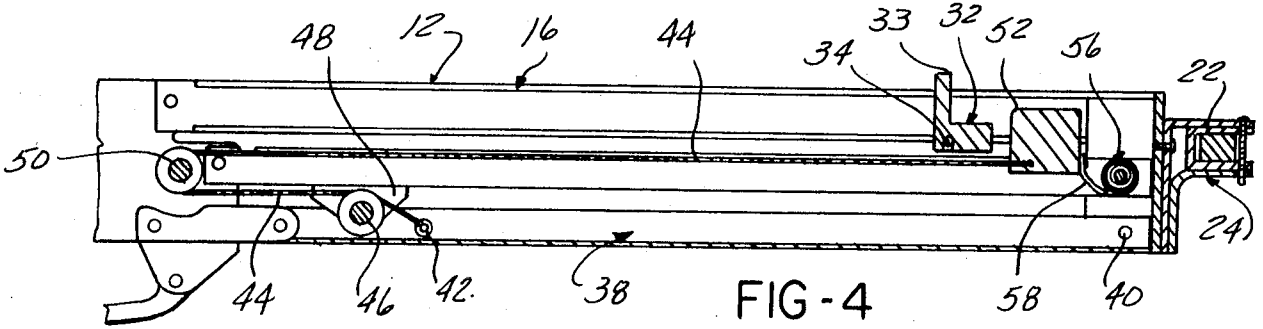
FIG. 4 is an enlarged fragmentary sectional view of a portion of the cross bow shown in FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

In co-pending application Attorney Docket Number BOZ-102, Ser. No. 778,405, there is disclosed a cross bow according to the configuration shown in FIGS. 1 and 2, in which the details thereof are set forth. Inasmuch as the present invention is directed to the cocking mechanism, the details of construction will not be hereinafter set forth for the sake of brevity.

Referring to the drawings, and particularly to FIGS. 1 and 2, a cross bow 10 includes an elongated stock member 12 including a butt portion 14, adapted to be positioned against the shoulder of the user, and a stock member frame 16 attached thereto with metal plates 18, forming a part of frame 16 and screws 20.

At the forward end of the stock member 12, is fixed a transversely extending prod 22 of suitable flexible, resilient material and is pivotally attached at its midpoint to the stock member frame 16.

The prod 22 is connected to the forward end of the stock member frame 16 by means of a clevis 24, which as to be pivotally mounted so as to be readily detachable to the stock member frame 16, as described in the referenced patent application in detail.

The prod 22 is adapted to be flexed by drawing of a central nocking point of drawstring 26 towards the rear of the stock member 12. For this purpose, an interconnection between the drawstring 26 segments lying on either side of the stock member 12, and the tips of the prod 22 is provided. As described in detail the interconnection comprises variable leverage devices 28 which by means of load cables 30 attached to each prod tip 22 causes flexing movement of the prod 22 upon motion of the nocking point of the drawstring 26, aligned with nocking point located at the point the drawstring 26 passes across the stock member 12.

The variable leverage devices 28 function to produce a variation in the force required in moving the drawstring 26 to the rear with increasing draw distance. As described in the aforementioned application in detail, it is important to constrain the side-to-side movement of the drawstring 26 with respect to the stock frame 16. Accordingly, a slider element 32 is provided, secured by means of bead fasteners 34, to the central point of the drawstring 26, preventing side-to-side movement relative the element 32.

A slider element 32 is itself in turn constrained to move in a lengthwise slot, comprising a track means 36, formed in the stock member frame 16 for the purpose described in the above referenced application; and includes a projection 33 adapted to engage a arrow or bolt to be launched.

The cocking mechanism according to the present invention includes an elongated cocking lever 38, pivotally mounted at 40 at its forward end to the front end of the stock member 12 and is adapted to be pivoted from a position lying alongside and beneath stock member 12, as shown in FIG. 1, to an extended position pivoted down and away therefrom, as shown in FIG. 3.

Attached at a point intermediate the length thereof, is one end of an operating cable 44 which is attached to cocking lever 38 at 42 so as to be pulled by the pivoting motion of the cocking lever 38, moving about its pivot mount 40.

Figure 5:
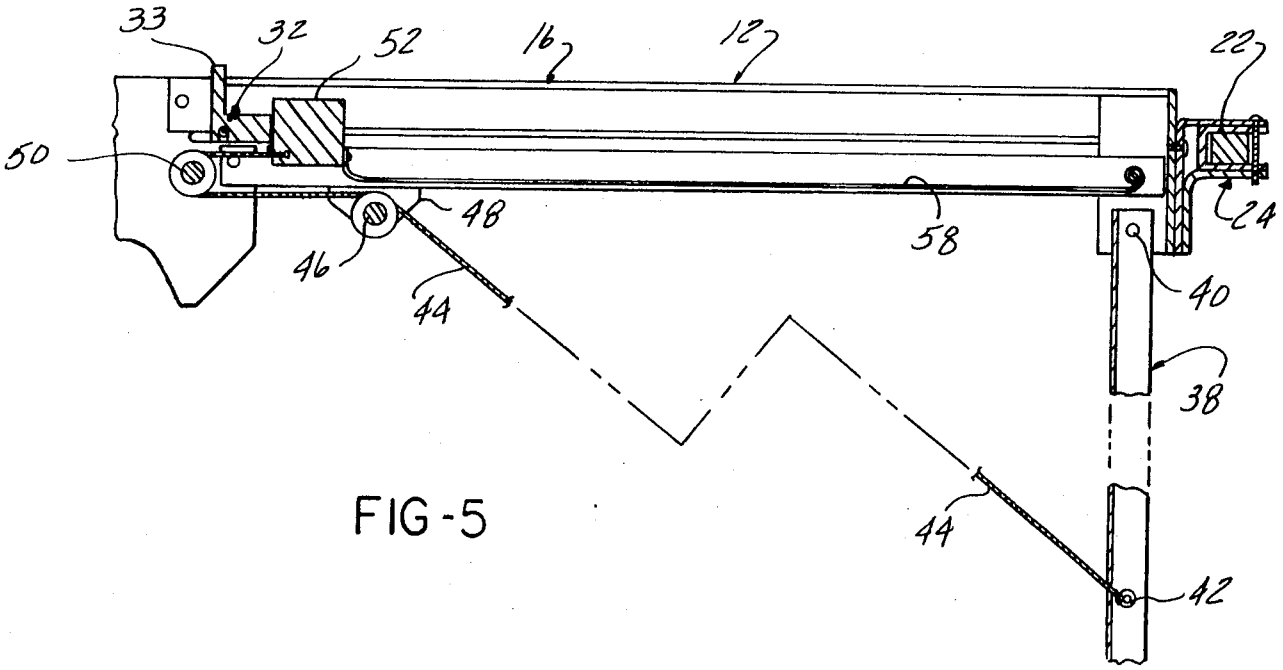
FIG. 5 is an enlarged fragmentary sectional view of a cross bow section as shown in FIG. 2, with the cocking mechanism in the extended position.

Operating cable 44 is directed by means of guiding means as best seen in FIGS. 4 and 5, and comprises a first pulley 46 located intermediate the length of the stock member 12, mounted by means of a bracket 48 secured to the underside of the stock member frame 16, and also located intermediate the length of the cocking lever 38. The guide means also includes a second pulley 50 spaced to the rear of first pulley 46 with the operating cable 44 passing above the first pulley 46 and around the second pulley 50, such as to extend lengthwise and forwardly through the stock member frame 12.

At the forward end of the stock member frame 16, the operating cable 44 is attached to an engagement block 52, also slidably mounted within the track 36 located forwardly of the slider element 32, so as to be engageable therewith upon pulling motion of the operating cable 44.

The engagement block 52 thus is able to come into contact with the slider element 32 as block 52 moves to the rear as the operating lever 38 is pivoted away from the stock member frame 16, as shown in FIG. 5, such as to cause slider element 32 to also be moved to the rear.

A suitable trigger mechanism 54, the details of which are not shown herein, serves to engage the slider element 32 and restrain it in the retracted or drawn position for selective release in conventional fashion.

In order to provide for return movement of the engagement block 52, a retraction means is provided, comprised of a wind up coil spring 56 mounted at the forward end of the stock member frame 12 including an extensible spring strip 58 attached to the forward end of the engagement block 52. As the engagement block 52 moves to the rear, the extensible spring strip 58 unwinds from the wind-up coil 56, but acts to urge the block 52 to the return, forward position.

The cocking lever 38 is formed with a handle portion 60, which includes a finger loop 62 able to be conveniently gripped by the user in order to accomplish the cocking motion with a bracket 64, securing the same to the strut 66, forming the main body of the cocking lever 38. Adjacent the finger loop 62 is a trigger guard 68 adapted to surround the trigger of the trigger mechanism 54, thus creating the familiar lever action appearance to the cross bow.

Accordingly, it can be seen that a relatively simple, yet effective cocking mechanism is provided which is also compact and able to be housed easily within the normal lines of the conventional cross bow, and which is advantageously combined with the constrained drawstring slider design according to the aforementioned co-pending patent application.

Referring to FIGS. 6–10, an alternate embodiment is described in which a cocking mechanism is incorporated in a conventional cross bow design.

The cross bow 10, in this instance, similarly includes a stock member 12 including a butt portion 14 and a stock member frame 16, connected by plates 18 and screws 20.

The prod 22 is rigidly affixed at the forward end mounted by any conventional means such as by clamping plates 23 which are attached by bolts 25.

The drawstring 26 is held in the drawn retractive position by a trigger mechanism 54, and selectively released for firing a bolt, (not shown) in the manner generally well known in the art.

Figure 6:
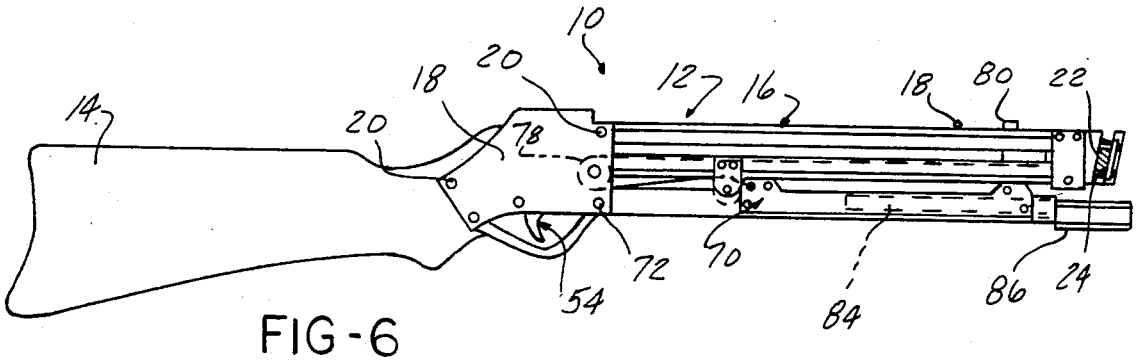
FIG. 6 is a side elevational view of a cross bow incorporating a cocking mechanism according to a second embodiment of the present invention, with the cocking mechanism in the return on normal position.
Figure 8:
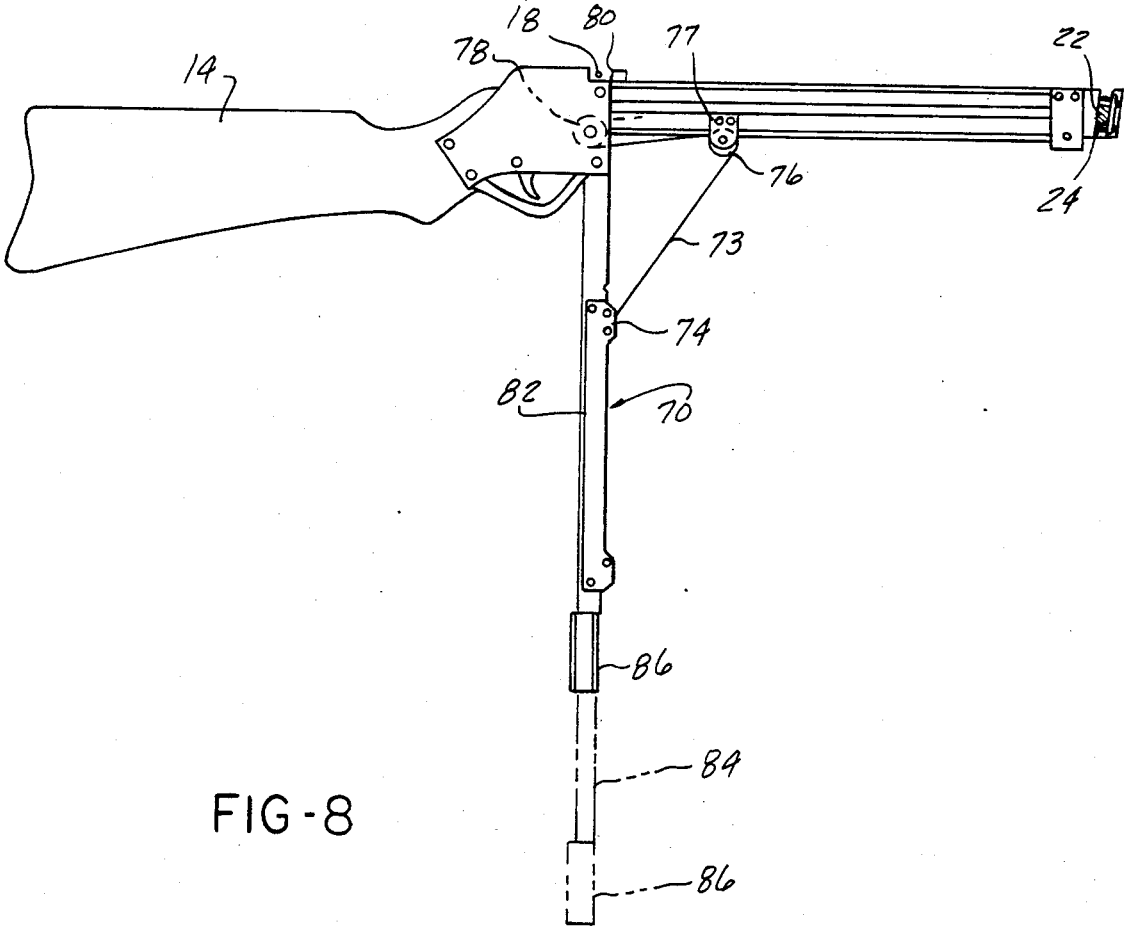
FIG. 8 is a side elevational view of the cross bow shown in FIG. 6 with the cocking mechanism in the fully extended position.

In this embodiment, a cocking lever 70 is provided which is pivoted at its rear end 72 to the stock member frame 16, such as to swing in an opposite sense from the above described embodiment, from a position underlying the stock member frame 16, as shown in FIG. 6 to a down and away position shown in FIG. 8. This pivoting motion accomplishes the drawing of the drawstring 18 to the fully drawn position.

This is also achieved by means of an operating cable 73 which is connected at one end at 74, to an intermediate point along the length of the cocking lever 70, such as to be pulled by the pivoting motion of the cocking lever 70 in moving away from the stock member 12.

Operating cable 73 passes around a first pulley 76 to a second pulley 78 spaced to the rear such that the operating cable may pass around to extend forwardly within the stock member frame 16 and be connected to the engagement block 80 as in the above described embodiment. The engagement block 80 is also slidably mounted in the track 36 slidably receiving the slider element 32.

Thus, the operating cable 73 pulls the engagement block 80 rearwardly to draw the drawstring to the rear to the fully drawn position shown in FIGS. 8 and 10. The trigger mechanism 54 is engageable therewith to hold the same in the fully retracted position, allowing return of the cocking lever 70.

Cocking lever 70 in this embodiment, is of two piece construction and includes members 82 and 84, member 84 having a handle 86 affixed thereto and adapted to be slidably engaged such that member 84 may be extended therefrom to increase the length of the cocking member 70 and increase the leverage able to be exerted thereby.

A retracting wind up coil spring 88 is also included having extensible strip 92 connected at 90 to the forward end of the engagement block 80. The retracting coil spring 88 is able to be unwound upon rearward travel of the engagement block 80, in the position as shown in FIG. 10 and upon release thereof rewound about a spring axle 96.

Accordingly, a very compact cocking mechanism is provided which affords easy and rapid cocking motion, and without the requirement of complex and bulky linkages.

What is claimed is:

1. In a cross bow for projecting bolts, said cross bow of the type including an elongated stock member, an elongated prod mounted transversely at a forward end of said stock member, a drawstring extending between the tips of said prod and across said stock member, and a trigger mechanism for releasably holding a central nocking point of said drawstring in a drawn position with said prod flexed, the improvement comprising a cocking mechanism for moving said drawstring to said drawn position, said cocking mechanism including an elongated cocking lever pivotally mounted at one end thereof to said stock member to be movable from a position lying along said stock member to a position rotated away therefrom, an operating cable attached at one end to said stock member so as to be pulled by said pivoting movement of said cocking lever away from said stock member, track means extending along said stock member;

an engagement block separate from said trigger mechanism mounted in said track means for movement therealong, said engagement block having portions located between said drawstring and said prod in all positions thereof in said track means, to be engageable with said drawstring;

said operating cable connected at the other end to said engagement block;

and operating cable guide means aligning said operating cable with said track means to cause said engagement block to be pulled rearwardly by said pivoting movement of said cocking lever; and, retraction spring means acting on said engagement block urging said engagement block forwardly to a position corresponding to the relaxed condition of said drawstring, whereby upon movement of said cocking lever towards said stock member and relaxation of said operating cable, said cable is pulled forwardly by said spring means.

2. The cross bow according to claim 1 wherein said guide means comprises a first pulley mounted to said stock member adjacent said cocking lever at a point intermediate the length thereof and a second pulley mounted to said stock member adjacent said cocking lever at a point spaced rearwardly from said first pulley, said operating cable passing around each of said first and second pulleys to extend forwardly from said second pulley to said engagement block.

3. The cross bow according to claim 1 wherein said spring means is a winding spring having an extensible resilient wind-up member attached to said engagement block.

4. The cross bow according to claim 1 wherein said cocking lever is pivotally attached at its forward end to the forward end of said stock member to pivot beneath said stock member, and includes a finger loop located rearwardly of said trigger mechanism, and a trigger guard surrounding said trigger mechanism.

5. The cross bow according to claim 1 wherein said cocking lever is pivotally mounted at its rear end to said stock member, and is comprised of first and second members extensible relative to each other to increase the length thereof and thereby increase the leverage able to be exerted thereby.

6. The cross bow according to claim 1 further including a slider element also movably mounted in said track affixed to said drawstring, said slider element engageable with said engagement block to indirectly cause engagement of said engagement block with said drawstring, and wherein said operating cable extends along said track and beneath said slider element to said engagement block.

7. The cross bow according to claim 6 wherein said operating cable extends within said stock member beneath said track means, and wherein said slider element includes a prong extending upwardly, to be engageable with a bolt to be projected along a path located above said operating cable.

* * * * *